United States Patent [19]

Ebihara

[11] Patent Number: 4,509,722

[45] Date of Patent: Apr. 9, 1985

[54] COMPOSITE VALVE SEAT

[75] Inventor: Tadashi Ebihara, Saitama, Japan

[73] Assignee: Nippon Piston Ring Co., Ltd., Tokyo, Japan

[21] Appl. No.: 351,385

[22] Filed: Feb. 23, 1982

[30] Foreign Application Priority Data

Feb. 26, 1981 [JP] Japan ..... 56-26117

[51] Int. Cl.[3] ..... F01L 3/00

[52] U.S. Cl. ..... 251/359; 251/368; 29/156.7 A; 428/548; 123/188 S

[58] Field of Search ..... 251/359, 368; 29/157.1 R, 156.7 A; 123/188 S; 428/548, 550, 565

[56] References Cited

U.S. PATENT DOCUMENTS

| | | | |
|---|---|---|---|
| 2,753,858 | 7/1956 | Honeyman et al. | 428/566 |
| 2,753,859 | 7/1956 | Bartlett | 428/539.5 |
| 3,373,003 | 3/1968 | Schreiner | 428/548 |
| 3,391,444 | 7/1968 | Haller | 428/548 |
| 3,428,035 | 2/1969 | Stefan et al. | 123/188 S |
| 3,770,332 | 11/1973 | Dunn | 428/548 |
| 3,795,511 | 3/1974 | Niimi et al. | 29/156.7 A |
| 4,217,875 | 8/1980 | Elsbett et al. | 123/188 S |
| 4,346,684 | 8/1982 | Vossieck | 123/188 S |

*Primary Examiner*—A. Michael Chambers

*Attorney, Agent, or Firm*—Sughrue, Mion, Zinn, Macpeak & Seas

[57] ABSTRACT

A composite valve seat has a valve spot surface zone made of a second sintered alloy which is a special sintered alloy and the remainder of the valve seat is made of a first sintered alloy which is an ordinary low-alloyed sintered alloy. A boundary between the first and second sintered alloys describes a curve which is, with the valve spot surface oriented upward, highest at an outer peripheral surface of the valve seat. The curved boundary gradually falls toward an inner peripheral surface of the valve seat and the shape of the curved boundary is similar to the powder rest curve of the first sintered alloy.

4 Claims, 11 Drawing Figures

51
50
5
6
7

91
A
5
6
7

52
A
5
6
7

B
92

83
8
50
5
7

5
7

COMPOSITE VALVE SEAT

BACKGROUND OF THE INVENTION

1. Field of the Invention

The present invention relates to a valve seat for use in an internal combustion engine, and more particularly, to a composite valve seat made of two kinds of sintered alloys.

2. Description of the Prior Art

As illustrated in FIG. 1, a spot surface 31 of a valve seat 3 always strikes a valve 4. Therefore, the spot surface 31 is subject to abrasion. In addition, when the valve seat 3 is positioned at the exhaust gas side of an engine, an inner peripheral surface 32 thereof is always exposed to high temperature exhaust gas. Therefore, the inner peripheral surface 32 is easily subject to corrosion. For valve seats used at the exhaust gas side, special materials having good abrasion resistance, heat resistance, and corrosion resistance are required. In these days, sintered alloys are usually used.

However, the sintered alloys which have good abrasion resistance, heat resistance and corrosion resistance are expensive since they contain large amounts of expensive elements, e.g., cobalt (co), nickel (Ni) and chromium (Cr). In view of the high material costs, composite valve seats as illustrated in FIGS. 2 and 3 are made which have only a zone 2 that is made of a special second sintered alloy. The remaining part of the valve seat constitutes a zone 1 which is made of a first sintered alloy 1 which is an ordinary less expensive sintered alloy. As can be seen by comparing the valve seats illustrated in FIGS. 2 and 3 the volume of the second sintered alloy contained in the valve seat of FIG. 3 is less than the volume of the second sintered alloy contained in the valve seat of FIG. 2. However, the volume of the second sintered alloy contained in the valve seat of FIG. 2 still tends to be excessive which unduly raises production costs.

SUMMARY OF THE INVENTION

Accordingly, an object of the invention is to provide a valve seat which requires a relatively small volume of a second sintered alloy and which has good abrasion resistance, heat resistance and corrosion resistance.

The composite valve seat of the present invention has a valve spot surface zone made of a second sintered alloy which is a special wear resistant sintered alloy. The remaining part of the valve seat comprises another zone which is made of a first sintered alloy which is an ordinary low-alloyed sintered alloy. The boundary between the second sintered alloy and the first sintered alloy, with the valve spot surface oriented upward, describes a curve which is highest at an outer peripheral surface of the valve seat and which gradually falls toward an inner peripheral surface of the valve seat. The shape of the boundary is similar to the powder rest curve of the first sintered alloy.

DESCRIPTION OF THE PREFERRED EMBODIMENTS

Figure 1:
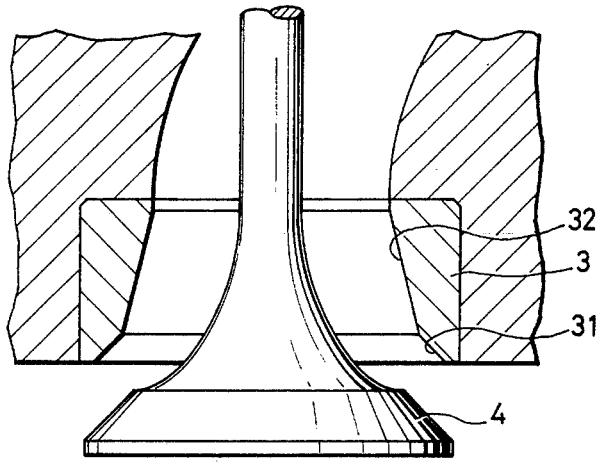
FIG. 1 is an illustrative cross-sectional view of a valve seat.
Figure 2:
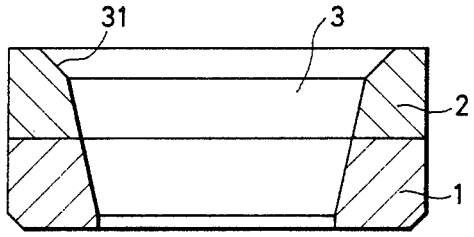
FIGS. 2 and 3 are cross-sectional views of conventional valve seats.
Figure 3:
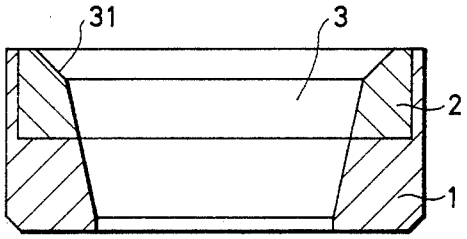
Figure 4:
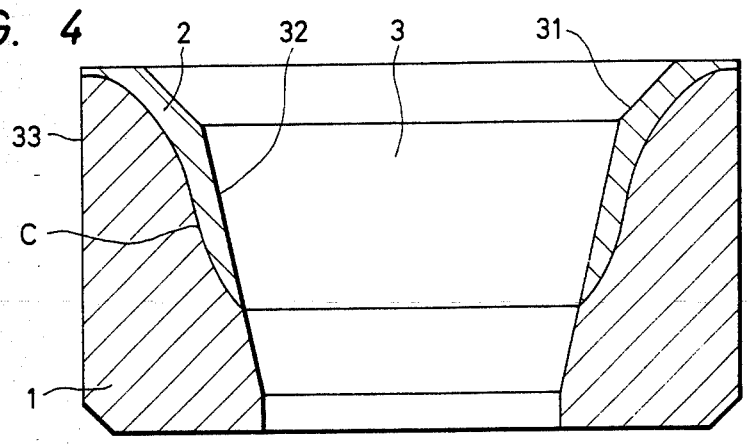
FIG. 4 is a cross-sectional view of a valve seat of the present invention.

Referring to FIG. 4, a boundary C between a first sintered alloy 1 and a second sintered alloy 2 in the cross-section of a valve seat 3 describes a curve which is, with a valve spot surface 31 oriented upward, highest at an outer peripheral surface 33 of the valve seat 3 and the boundary C falls gradually towards an inner peripheral surface 32 of the valve seat 3. The shape of the boundary C is similar to the powder rest curve of the first sintered alloy.

In the composite valve seat of the invention, the valve spot surface 31 and the inner peripheral surface 32 of the valve seat are covered by the second sintered alloy 2. The boundary C between the first and second sintered alloys 1 and 2 is almost parallel to the inner peripheral surface 32. This construction markedly reduces the required volume of the second sintered alloy 2. The volume of the second sintered alloy is smaller than that of conventional valve seats since the boundary between the first and second alloys of the valve seat of the invention has a shape similar to the shape of the inner peripheral surface of the valve seat whereas the boundary between the first and second sintered alloys in conventional valve seats is straight with the second sintered alloy zone being defined by an axis of the valve seat and a line perpendicular to or parallel to the axis.

Figures 5A, 5B, 5C, 5D, 5E, 5F:
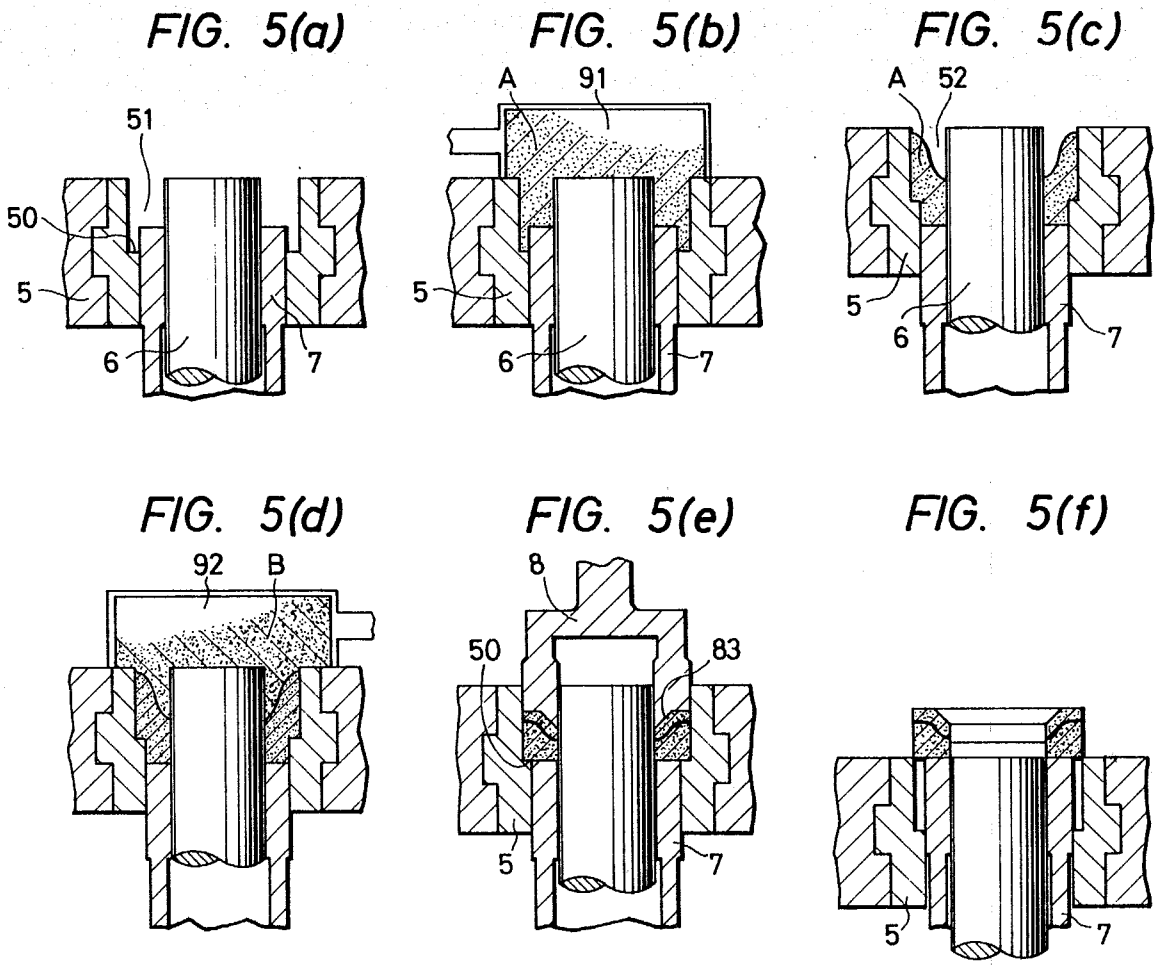
FIG. 5 shows a series of working steps illustrating a method of producing the valve seat of the invention.

The composite valve seat of the invention can be produced by a method comprising a series of working steps as illustrated in FIG. 5. This method comprises the following seven steps:

1st Step: A die 5 with a step 50 and a core rod 6 are lifted to form a first space 51 (FIG. 5(*a*)).

2nd Step: A first powder A is charged into the first space 51 with a first feed shoe 91 (FIG. 5(*b*)).

3rd Step: The die 5 and the core rod 6 are lifted so that the top surface of the first powder A forms a shape nearly equal to the rest curve thereof over the step of the core rod and a lower punch 7 thereby forming a second space 52 (FIG. 5(*c*)).

4th Step: A second powder B is charged into the second space 52 by means of a second feed shoe 92 (FIG. 5(*d*)).

5th Step: An upper punch 8 having the shape of the valve seat spot surface is lowered to perform the powder compression molding. Alternatively, the upper punch 8 is lowered until it reaches the upper surface of the powder B. Then the die 5 is lowered. When the height of the die step 50 is equal to the height of the lower punch 7, the die 5 is stopped. Then the upper punch 8 is lowered to perform the powder compression molding (FIG. 5(*e*)).

6th Step: The die 5 and the core rod 6 are lowered, and simultaneously the upper punch 8 is lifted to remove the powder compression molded article (FIG. 5(*f*)).

7th Step: The article thus produced is sintered and the surface thereof is subjected to dimensinal working.

Although the above explanation has been made to an embodiment wherein the lower punch 7 is fixed, it goes without saying that the object of the invention can also be formed by a method in which the die 5 is fixed as long as the relative movements of the die, lower punch and upper punch correspond to those in the method of production shown in FIG. 5. Moreover, the 1st, 2nd, 3rd and 4th steps may be performed at the same time (i.e., suction type charging).

By controlling the rate and amount by which the die 5 is raised, the shape of the curve formed on the upper surface of the first powder A, which is similar to the rest curve, can be accurately controlled.

Figure 6:
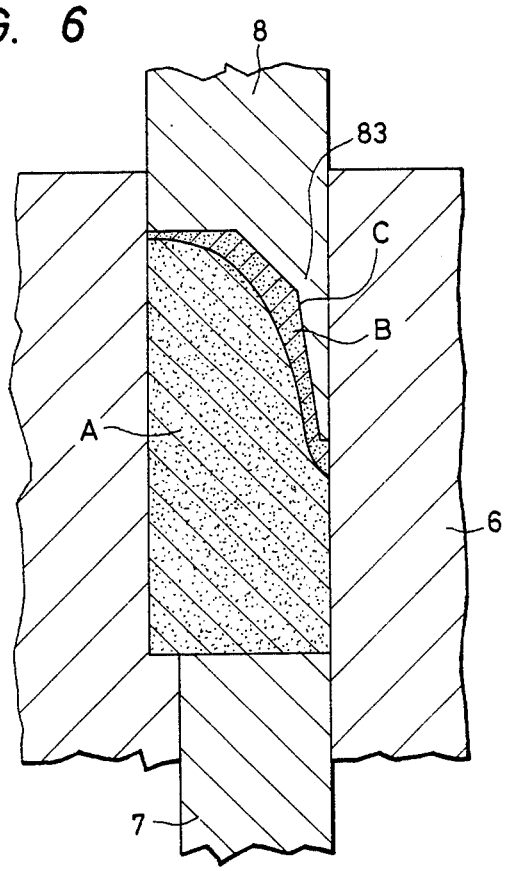
FIG. 6 is another view showing the valve seat of the invention and a particular shape of an upper punch used to make the valve seat.

The method described above permits the composite valve seat of the invention to be easily produced. Furthermore, if a projection 83 is formed on the upper punch 8, a spot surface of the valve seat as shown in FIG. 6 is readily formed which results in the second powder B covering a very large portion of the inner peripheral surface of the valve seat. Therefore, the inner peripheral surface of the valve seat is more widely covered by the second sintered alloy.

The composite valve seat of the invention may be, if necessary, subjected to treatments such as infiltration, impregnation and sulfurization.

As described above, in the valve seat of the invention, only the zone which is required to have good abrasion resistance, heat resistance and corrosion resistance, which is defined by the outer line of the valve seat and a boundary between the first and second sintered alloys, is made of the second sintered alloy. The amount of the second sintered alloy therefore required is markedly reduced.

Although the above described method of production is suitable for the production of the valve seat of the invention, it can be produced by other methods of production as well.

What is claimed is:

1. A composite valve seat formed around a core rod by compressing first and second layers within a surrounding die between upper and lower punches, said valve seat comprising:

first and second zones, said first zone comprising said first layer and being made of a first sintered alloy powder, said second zone comprising said second layer and being made of a second sintered alloy powder, a boundary between said first and second sintered alloy powders having a rest-curvelike shape formed by relative movement between said die and lower punch after said first sintered alloy powder is deposited within said die on an upper surface of said lower punch but prior to said second sintered alloy powder being deposited on said first sintered alloy powder.

2. The composite valve seat claimed in claim 1, wherein said second sintered alloy has better abrasion, heat and corrosion resistance than said first sintered alloy.

3. The composite valve seat claimed in claim 1, wherein first and second layers are compressed around a core rod passing through said die, and wherein said rest-curvelike shape is further formed by relative movement between said core rod and said lower punch.

4. The composite valve seat claimed in claim 3, wherein said second sintered alloy powder is deposited on said first sintered alloy powder subsequent to said relative movement between said die and punch and between said core rod and punch.

* * * * *